United States Patent [19]

Voss et al.

[11] Patent Number: 4,775,478

[45] Date of Patent: Oct. 4, 1988

[54] PROCESS FOR REMOVING ACID FROM CATHODIC ELECTROCOATING BATHS

[75] Inventors: Hartwig Voss, Frankenthal; Thomas Brüecken, Dortmund, both of Fed. Rep. of Germany

[73] Assignee: BASF Aktiengesellschaft, Ludwigshafen, Fed. Rep. of Germany

[21] Appl. No.: 90,445

[22] Filed: Aug. 28, 1987

[30] Foreign Application Priority Data

Sep. 3, 1986 [DE] Fed. Rep. of Germany ..... 3629981

[51] Int. Cl.[4] ..... B01D 13/00; B01D 15/04

[52] U.S. Cl. ..... 210/638; 210/651

[58] Field of Search ..... 210/638, 641, 650, 651, 210/653, 654

[56] References Cited

U.S. PATENT DOCUMENTS

| | | | |
|---|---|---|---|
| 3,132,094 | 5/1964 | McKelvey et al. | 210/641 |
| 3,495,465 | 2/1970 | Nordsieck | 74/5 |
| 3,663,405 | 5/1972 | Christenson et al. | 204/181 |
| 3,663,406 | 5/1972 | Le Bras et al. | 204/181 |
| 4,031,050 | 6/1977 | Jerabek | 260/29.2 TN |
| 4,190,567 | 2/1980 | Ohmura et al. | 260/29.2 TN |
| 4,412,922 | 11/1983 | Mir | 210/638 |
| 4,560,480 | 12/1985 | Lacroix et al. | 210/638 |
| 4,581,111 | 4/1986 | Christenson et al. | 204/182.1 |
| 4,664,808 | 5/1987 | Kim | 210/638 |

FOREIGN PATENT DOCUMENTS

| | | |
|---|---|---|
| 1143498 | 3/1983 | Canada . |
| 0166015 | 1/1986 | European Pat. Off. . |
| 2111081 | 6/1983 | United Kingdom . |

OTHER PUBLICATIONS

Loop (1978) Cathodic Electrodeposition for Automobile Coatings, World Surface Coatings Abstracts; Abst. 3929.

*Primary Examiner*—Ivars Cintins

*Attorney, Agent, or Firm*—Keil & Weinkauf

[57] ABSTRACT

The present invention relates to a novel process for removing acids from cathodic electrocoating baths, in which electrically conductive substrates are coated with cationic resins present in the form of aqueous dispersions, part or all of the dip-coating bath being subjected to an ultrafiltration in which the ultrafiltration membrane retains the cationic resin and an ultrafiltrate is formed which contains water, solvent, low molecular weight substances and ions, and part or all of the ultrafiltrate being recycled to the coating bath, in which process (a) part or all of the ultrafiltrate, before recycling to the electrocoating bath and (b) an aqueous solution of an organic or inorganic base, which may or may not contain salts, are each introduced into one or more chambers, separated from one another by an anion exchange membrane, of an exchange cell, solutions (a) and (b) being led over the surface of the membrane.

8 Claims, No Drawings

PROCESS FOR REMOVING ACID FROM CATHODIC ELECTROCOATING BATHS

The present invention relates to a novel process for removing acid from cathodic electrocoating baths, in which electrically conductive substrates are coated with cationic resins present in the form of aqueous dispersions, part or all of the dip-coating bath being subjected to an ultrafiltration in which the ultrafiltration membrane retains the cationic resin and an ultrafiltrate is formed which contains water, solvent, low molecular weight substances and ions, and part or all of the ultrafiltrate being recycled to the coating bath.

Cathodic electrocoating is known and is described in detail in, for example, F. Loop, Cathodic electrodeposition for automotive coatings, World Surface Coatings Abstracts (1978), Abs. 3929.

In this process, electrically conductive substrates are coated with cationic resins present in the form of aqueous dispersions. Resins which can be cathodically deposited usually contain amino groups. In order to convert them into a stable aqueous dispersion, they are protonized with acids (which in some publications are also referred to as solubilizers), such as formic acid, acetic acid, lactic acid or phosphoric acid. During an electrocoating operation, the protonization is again reversed in the immediate vicinity of the metallic article to be coated, by neutralization with the hydroxyl ions formed by electrolytic decomposition of water, so that the binder precipitates (or coagulates) on the substrate. The acid is not coprecipitated, so that as the coating process progresses acid accumulates in the bath. This lowers the pH, leading to destabilization of the electrocoating material. Hence, the excess acid must be neutralized or removed from the bath.

U.S. Pat. No. 3,663,405 describes ultrafiltration of electrocoating compositions. During ultrafiltration, the electrocoating composition is passed, under a certain pressure, along a membrane which retains the higher molecular weight consituents of the composition while it allows low molecular weight constituents, such as organic impurities, decomposition products, resin solubilizers (acids) and solvents, to pass through the membrane. To remove these low molecular weight constituents, part of the ultrafiltrate is discarded and hence removed from the system. Another part of the ultrafiltrate is fed to the flushing zone of the coating line and is used there to achieve drag-out, i.e. to flush off the coating dispersions still adhering to the coated articles. To recover the drag-out, the ultrafiltrate and flushed-off coating dispersion are returned to the electrocoating tank. Since the solubilizer is used in large quantities it is not possible to remove it from the bath in adequate amount by discarding ultrafiltrate.

U.S. Pat. No. 3,663,406 describes the combined use of ultrafiltration and electrodialysis for working up and control of the solubilizer balance of electrocoating compositions. The electrodialysis is installed in the electrocoating tank in such a way that the counter-electrode for the coated article is separated from the actual coating composition by a semipermeable membrane and an electrolyte which contains the solubilizer. When an electric field is applied, the ions of opposite charge to the ionic resin groups migrate through the ion exchange membrane into the electrolyte and can from there be discharged via a separate circuit. These electrodialysis units installed in the electrocoating tank require much space and a great deal of servicing. The membranes can become clogged with coating particles or can be mechanically damaged by the articles to be coated, thus necessitating replacement of the membranes. This requires much time, is expensive, and can cause the coating process to be shut down for a certain period.

For this reason there are processes which make it possible to shift the electrodialysis from the electrocoating tank into the peripheral parts of the installation. German Pat. No. 3,243,770 and European Pat. No. 0,156,341 describe processes of this type, in which the part of the ultrafiltrate which is recycled into the flushing zone and then into the electrocoating tank is subjected to an electrodialysis treatment before it enters the flushing zone. This allows the solubilizers (acids) accumulated in the ultrafiltrate to be removed from the coating process. The great disadvantage of this electrodialysis process is that lead, originating from an anticorrosion pigment, is deposited on the cathode alongside other cations. For this reason, the cathode was designed to be mobile and hence capable of regeneration, but this is very expensive.

It is an object of the present invention to remove excess acid from the ultrafiltrate of cathodic electrocoating baths without incurring the disadvantages described above.

We have found, surprisingly, that this object is achieved by removing the acid from the ultrafiltrate without electrodialysis, via an exchange cell, i.e. by dialysis.

Further, it has been found that all cations and solvents remain in the ultrafiltrate after the dialysis treatment.

Accordingly, we have found a process for removing acids from cathodic electrocoating baths, in which electrically conductive substrates are coated with cationic resins present in the form of aqueous dispersions, part or all of the dip-coating bath being subjected to an ultrafiltration in which the ultrafiltration membrane retains the cationic resin and an ultrafiltrate is formed which contains water, solvent, low molecular weight substances and ions, and part or all of the ultrafiltrate being recycled to the coating bath, in which process (a) part or all of the ultrafiltrate, before recycling to the electrocoating bath and (b) an aqueous solution of an organic or inorganic base, which may or may not contain salts, are each introduced into one or more chambers, separated from one another by an anion exchange membrane, of an exchange cell, solutions (a) and (b) being led over the surface of the membrane.

A large number of finishes may be used for cathodic electrocoating. They acquire their ionic character from cationic resins which usually contain amino groups and which are neutralized with conventional acids, for example formic acid, acetic acid, lactic acid or phosphoric acid, thereby forming cationic salts groups. Such compositions which can be cationically deposited are described in, for example, U.S. Pat. Nos. 4,031,050 and 4,190,567, German Laid-Open Application DE-OS No. 2,752,555 and European Patent Application No. 12,463.

These cationic resin dispersions are combined with pigments, soluble dyes, solvents, levelling agents, stabilizers, antifoams, crosslinking agents, curing catalysts, lead salts and other metal salts, as well as other assistants and additives, to form the electrocoating compositions.

For cathodic electrocoating, the solids content of the electrocoating bath is in general adjusted to 5–30, preferably 10–20, % by weight by dilution with demineralized water. Coating is in general carried out at from 15° to 40° C. for from 1 to 3 minutes at a pH of the bath of 5.0–8.5, preferably 6.0–7.5, at deposition voltages of from 50 to 500 volt. After flushing the film deposited on the electrically conductive article, the film is cured at about 140° C.–200° C. for 10–30 minutes, preferably at 150°–180° C. for about 20 minutes.

Electrocoating baths are operated continuously, i.e. the articles to be coated are continuously introduced into the bath, coated and then removed again. It is therefore also necessary to feed the bath continuously with coating composition.

After some months' operation, undesirable impurities and solubilizer accumulate in the bath. Examples of such impurities are oils, phosphates and chromates (which are introduced into the bath by the substrates to be coated), carbonates, excess solubilizer, solvents and oligomers which accumulate in the bath because they are not deposited with the resin. Such undesirable constituents have an adverse effect on the coating process, so that the chemical and physical properties of the deposited film become unsatisfactory.

In order to remove these impurities and to keep the composition of the electrocoating bath relatively constant, part of the bath is withdrawn and subjected to ultrafiltration.

The solutions to be ultrafiltered are brought into contact under pressure (for example applied by means of a compressed gas or a liquid pump) with a filtration membrane, arranged on a porous carrier, in a cell. Any membrane and any filter which is chemically compatible with the system and possesses the desired separation properties may be used. Preferably, the contents of the ultrafiltration cell are stirred in order to prevent accumulation of the retained material on the membrane surface and formation of a firm deposit of these materials on the membrane. Ultrafiltrate is formed continuously and is collected until the retained solution in the cell has reached the desired concentration or the desired proportion of solvent or solvents containing dissolved low molecular weight substances has been removed. Suitable ultrafiltration devices are described in, for example, U.S. Pat. No. 3,495,465.

Though ultrafiltration may be employed to remove numerous impurities from the coating bath, it does not permit satisfactory removal of solubilizers from the bath. One of the reasons is that in industrial use the ultrafiltrate is used to wash and flush freshly coated articles in order to flush off loosely adhering coating particles. This wash solution is recycled to the coating bath. Though part of the ultrafiltrate is usually discarded, this as a rule does not suffice to remove the excess acid. Hence it is necessary to feed part or all of the ultrafiltrate to an exchange cell.

The dialysis process is carried out in an exchange cell which comprises two or more chambers separated by an anion exchange membrane, so as to permit two mutually separate streams of liquid to be employed. Exchange cells of this type are used, for example, for known electrodialysis processes, but in the present case the electrode chambers are dispensed with since no electrical field is required. A suitable apparatus is described in, for example, European Pat. No. 126,830. Very suitable exchange cells are, for example, devices equipped with membrane stacks and containing a plurality, for example from 2 to 800, parallel chambers. Since no electrical field need be applied, the process is not restricted to the use of these plate membrane modules. All other exchange cells, such as hollow fiber modules, tube modules or coil modules, may also be employed. The chambers of the exchange cells can be fed alternaely with aqueous solutions (a) and (b), solution (b) being an aqueous solution of an organic or inorganic base, which may or may not contain salts. The inorganic bases used are alkali metal, alkaline earth metal or ammonium hydroxides or carbonates. Sodium hydroxide, potassium hydroxide, sodium carbonate, potassium carbonate, calcium hydroxide, barium hydroxide, ammonia and ammonium carbonate are preferred. Organic bases which may be used are amines, such as the trialkylamines, for example trimethylamine and triethylamine, diazabicyclooctane and dicyclohexylethylamine, polyamines, such as polyethyleneimines and polyvinylamines, or quaternary ammonium hydroxides. Solution (b) in general has a pH of from 7 to 14, preferably from 11 to 13.

If desired, solution (b) contains, in addition to the stated bases, one or more salts, preferably consisting of a cation of the above bases and an anion of the conventional acids mentioned above, in a concentration of from 0.001 to 10 equivalents per liter, preferably from 0.001 to 1 equivalent per liter. Sodium acetate, potassium acetate, sodium lactate and potassium lactate are preferred.

The process may be carried out continuously or batchwise. In the bathwise process, the solutions execute a multiple pass, and in a continuous process a single pass, through the exchange cell. The two solutions may be passed through the exchange cell in parallel current, cross-current or counter-current. The exchange cells may be arranged in the form of a multistage cascade, especially for continuous operation.

Conventional anion exchange membranes may be used for the process; these, for example, have a thickness of from 0.1 to 1 mm and a pore diameter of from 1 to 30 μm, or have a gel-like structure. Since a diffusion process is concerned, particularly thin membranes, for example with thickness less than 0.2 mm, are preferred.

The anion exchange membranes are constructed, in accordance with a well known principle, of a matrix polymer functionalized with cationic groups.

Examples of matrix polymers are polystyrene (cross-linked with, for example, divinylbenzene or butadiene), high density and low density polyethylene, polysulfone and polytetrafluoroethylene.

The matrix polymers are functionalized by, for example, copolymerization, grafting or condensation with monomers possessing cationic groups. Examples of such monomers are vinylbenzylammonium, vinylpyridinium or vinylimidazolidinium salts. Amines which additionally contain quaternary ammonium groups are introduced into the matrix polymer by amide or sulfonamide condensation reactions.

Polystyrene-based membranes are marketed under, for example, the trade marks Selemion® (from Asahi Glass), Neosepta® (from Tokoyama Soda) or Aciplex® (from Asahi Chem.

Membranes based on polyethylene grafted with quaternary vinylbenzylamine are commercially available under the trade mark Raipore® R-5035 (from RAI Research Corp), while those with grafted polytetrafluoroethylene are available under the trade mark Raipore® R-1035.

EP-A No. 166,015 described membranes based on polytetrafluoroethylene and having a quaternary ammonium grouo bound via a sulfonamide group.

The anion exchange membranes are very stable to an alkaline medium.

Though the process is distinguished by high exchange rates, the exchange rate can, depending on the process conditions and on the electrocoating compositions employed, drop after a certain period of operation. In such cases, the membranes are subjected to an intermediate flushing with, for example, dilute acids.

The flowrate with which solutions (a) and (b) are passed through the exchange cell is in general from 0.001 m/s to 2.0 m/s, preferably from 0.01 to 0.10 m/s.

The dialysis is as a rule carried out at from 0° to 100° C., preferably from 20° to 50° C., under pressures of from 1 to 10 bar, preferably at atmospheric pressure. The pressure drop across the membranes employed is up to 5 bar, in particular up to 0.2 bar.

The cathodic electrocoating process is used to coat electrically conductive surfaces, for example automotive bodywork, metal articles, metal sheet etc., made of brass, copper or aluminum, metallized plastics or materials coated with conductive carbon, as well as iron and steel which may or may not have been chemically pretreated, for example phosphatized.

The process for removing acid from the electrocoating bath is distinguished by high exchange rates.

EXAMPLE 1

150 g of ultrafiltrate (solution (a)) of pH 5.74 are circulated by pumping, via a stock vessel, through the middle chamber of a circular three-chamber exchange cell having two anion exchange membranes of the Selemion DMV type, from Asahi Glass, the membranes being spaced at 1 cm distance and each having a surface area of 3.14 $cm^2$, at 25° C., until a pH of 6.5 was reached. 150 g of an 0.02 N aqueous sodium hdyroxide solution (solution b)), of pH 12.2, were circulated by pumping, via a stock vessel, through the two outer chambers at 25° C. for the same period of time. After completion of the experiment, no change in weight of either solution was detectable.

The changes in the composition of the solutions, and the measured data, are shown in the table.

EXAMPLE 2

This example was carried out analogously to Example 1, with the sole difference that solution (b) was a mixture of 0.02 equivalent/l of sodium hydroxide and 0.17 equivalent/l of sodium acetate.

EXAMPLE 3

900 g of ultrafiltrate of pH 5.74 was circulated by pumping, as in Example 1, through the middle chamber of a laboratory plate stack cell having two anion exchange membranes of the Selemion DMV type, spaced at a distance of 0.3 cm and each having a surface area of 37.8 $cm^2$, at 25° C., until a pH of 6.5 was reached.

EXAMPLE 4

1,000 g of ultrafiltrate from another electrocoating compostion, of pH 5.88, were circulated by pumping, as in Example 1, through the middle chamber of a laboratory plate stack cell (as described in Example 3), until a pH of 6.5 was reached. Solution (b) was an 0.01N sodium hydroxide solution, of pH 11.8.

EXAMPLE 5

The same experimental arrangement, and an ultrafiltrate of the same electrocoating composition, as in Example 4 were used. Solution (b) was an 0.001N sodium hydroxide solution of pH 10.4. The pH of solution (b) was kept between 9.4 and 10.6 by regular addition of 0.01N NaOH solution.

TABLE

| | Composition of solution (a) | | | | | | | | | |
|---|---|---|---|---|---|---|---|---|---|---|
| Examples | Base (N) $10^2$ | Acid (N) $10^2$ | Solids content (%) | Pb (ppm) | Na (ppm) | Cl (ppm) | Solvent (%) | (b) $c_{NaOH}$ (N) | Flow time (min) | Capacity $\frac{Kg\ UF}{m^2 \cdot h}$ |
| Ultrafiltrate (UF) employed | 1.6 | 2.39 | 0.51 | 685 | 10 | | | | | |
| 1 | 2.39 | 1.79 | 0.4 | 670 | 11 | | | 0.02 | 119 | 120.9 |
| 2 | 2.39 | 1.80 | 0.39 | 680 | 9.5 | | | 0.02 | 110 | 130.7 |
| 3 | | | | 685 | | | | 0.02 | 46 | 152 |
| Ultrafiltrate (UF) employed | 2.35 | 2.47 | 0.39 | 490 | 6.6 | 13 | 1.74 | | | |
| 4 | 2.54 | 2.02 | 0.39 | 470 | 6.7 | 11 | 1.79 | 0.01 | 82 | 96.8 |
| 5 | 2.50 | 1.76 | 0.39 | 470 | 5.1 | 13 | 1.69 | 0.001 | 450 | 17.8 |

We claim:

1. A process for removing acid from cathodic electrocoating baths, in which electrically conductive substrates are coated with cationic resins present in the form of aqueous dispersions, at least a part of the cathodic electrocoating bath being subjected to an ultrafiltration in which the ultrafiltration membrane retains the cationic resin and an ultrafiltration is formed which contains water, solvent, low molecular weight substances and ions, at least a part of the ultrafiltration being recycled to the coating bath, in which process
   (a) at least a part of the ultrafiltrate, before recycling to the electrocoating bath, and
   (b) an aqueous solution of an organic or inorganic base, are introduced into at least one chamber of a multichamber exchange cell, said chambers being separated from one another by an anion exchange membrane, said solutions (a) and (b) being led over the surfaces of the membrane.

2. The process of claim 1, wherein solutions (a) and (b) are passed over the anion exchange membrane at a flowrate of 0.001–2.0 m/s at 0°–100° C.

3. The process of claim 1, wherein solution (a) contains at least one of the following acids: formic acid, acetic acid, lactic acid and phosphoric acid.

4. The process of claim 1, wherein the aqueous solution (b) contains sodium hydroxide, potassium hydroxide, sodium carbonate, potassium carbonate, calcium hydroxide, barium hydroxide, ammonia or ammonium carbonate and has a pH of 7–14.

5. The process of claim 4, wherein the pH of the solution is from 11–13.

6. The process of claim 1, wherein the aqueous solution (b) is a solution of an amine or quaternary ammonium compound and has a pH of 7–14.

7. The process of claim 6, wherein the pH of the solution is from 11–13.

8. The process of claim 1, wherein solution (b) contains, in addition to the base at least one dissolved salt, in a concentration of 0.001–10 equivalents per liter.

* * * * *